US010756484B1

(12) United States Patent
Schmidt

(10) Patent No.: US 10,756,484 B1
(45) Date of Patent: Aug. 25, 2020

(54) ELECTRICAL SPLICE CONNECTOR

(71) Applicant: Fluence Bioengineering, Inc., Austin, TX (US)

(72) Inventor: Jonathan Becker Schmidt, Round Rock, TX (US)

(73) Assignee: Fluence Bioengineering, Inc., Austin, TX (US)

( * ) Notice: Subject to any disclaimer, the term of this patent is extended or adjusted under 35 U.S.C. 154(b) by 0 days.

(21) Appl. No.: 16/429,414

(22) Filed: Jun. 3, 2019

(51) Int. Cl.

| | |
|---|---|
| ***H01R 13/623*** | (2006.01) |
| ***H01R 4/18*** | (2006.01) |
| ***H01R 13/424*** | (2006.01) |
| ***H01R 33/22*** | (2006.01) |
| ***H01R 4/64*** | (2006.01) |
| ***H01R 13/52*** | (2006.01) |
| *H01R 103/00* | (2006.01) |

(52) U.S. Cl.
CPC ..... *H01R 13/623* (2013.01); *H01R 4/185* (2013.01); *H01R 4/646* (2013.01); *H01R 13/424* (2013.01); *H01R 13/5208* (2013.01); *H01R 33/22* (2013.01); *H01R 2103/00* (2013.01)

(58) Field of Classification Search
CPC ..... H01R 13/623; H01R 4/24; H01R 4/3408; H01R 12/616; H01R 9/031; H01R 13/582; H01R 13/5205; F21V 21/06; F21V 21/0824; F21V 27/00
USPC ..... 439/277, 413, 415, 272, 273, 489, 395, 439/399, 400, 401, 402, 403, 404, 408
See application file for complete search history.

(56) References Cited

U.S. PATENT DOCUMENTS

| | | | | | |
|---|---|---|---|---|---|
| 2,700,142 | A * | 1/1955 | Benander | H01R 4/2408 | 439/413 |
| 2,742,549 | A * | 4/1956 | Peters | H01R 4/2408 | 338/21 |
| 3,372,361 | A * | 3/1968 | Wengen | H01R 4/2408 | 439/412 |
| 3,688,247 | A * | 8/1972 | Prodel | H01R 4/2483 | 439/416 |
| 4,446,332 | A * | 5/1984 | Dauser, Jr. | H01R 4/2491 | 174/87 |
| 5,601,448 | A * | 2/1997 | Poon | F21V 21/002 | 439/417 |
| 5,816,844 | A | 10/1998 | Perera | | |
| 5,928,026 | A * | 7/1999 | Hsu | H01R 4/2408 | 439/413 |
| 5,939,672 | A * | 8/1999 | Tang | H01R 4/2433 | 174/50.5 |
| 6,364,690 | B1 * | 4/2002 | Nehm-Engelberts | H01R 9/031 | 439/394 |

(Continued)

FOREIGN PATENT DOCUMENTS

GB 1198797 7/1970

*Primary Examiner* — Harshad C Patel
(74) *Attorney, Agent, or Firm* — Yutian Ling

(57) ABSTRACT

Apparatuses and methods disclosed herein include an electrical connector. The electrical connector may include an upper cap configured to engage with an end cap, the upper cap including an upper cap insert that is independent from the upper cap in at least one axis of motion. The end cap may include one or more contact blades configured to receive an insulated cable. As the upper cap engages with the end cap the upper cap insert may press the insulated cable onto the one or more contact blades such that the one or more contact blades are in electrical connection with one or more conductors in the insulated cable.

15 Claims, 6 Drawing Sheets

(56) References Cited

U.S. PATENT DOCUMENTS

| | | | | |
|---|---|---|---|---|
| 7,063,556 | B1 * | 6/2006 | Wong | H01R 4/2408 439/411 |
| 7,635,279 | B1 * | 12/2009 | Wong | H01R 4/4836 439/419 |
| 8,101,874 | B2 * | 1/2012 | Yang | H02G 3/088 166/297 |
| 8,616,905 | B2 * | 12/2013 | McGregor | H01R 4/2408 439/207 |
| 9,593,843 | B2 * | 3/2017 | McRory | H04N 7/185 |
| 9,948,012 | B2 * | 4/2018 | McGregor | H01R 4/2408 |
| 2008/0081507 | A1 * | 4/2008 | Mahajan | H01R 4/2404 439/410 |

* cited by examiner

ELECTRICAL SPLICE CONNECTOR

FIELD OF THE DISCLOSURE

This disclosure relates to electrical connectors, and specifically to an apparatuses and methods for providing a waterproof electrical splice connector for various applications, including horticultural lighting.

BACKGROUND

A splice connector, otherwise known as an insulation displacement connector (IDC), is a type of electrical connector in which the insulation of a conducting cable is pierced by blades in order to make an electrical connection with another conductor. For example, a slot in the blade may act as a trough or cradle that touches the conducting cable to create the electrical connection. This avoids the need to strip or otherwise remove the insulator to make the electrical connection. IDCs are mainly used in applications where electrical connections should be made quickly without the need for a skilled worker to set up the connection. For example, this may occur when electrical connections are made in the field (e.g., by an installer of a piece of equipment).

In environments that are wet or humid, it is important for electrical connections to be waterproof or water resistant in order to avoid short circuits and electrical shock dangers. Currently, there are a limited number of options for waterproof IDCs, each with their own drawbacks. For example, some connectors may require tools in order to insert the cable into the connector, which makes installation more complicated and time consuming. Other connectors may also connect a single cable, so if multiple cables need to be connected then many connectors need to be used. Other connectors may use a viscous dielectric substance to seal the connection, which is a messy solution. Thus, there exists a need in the art for waterproof IDCs that are simple to install and have the capability to connect multiple cables.

SUMMARY

The apparatuses and methods disclosed herein include an electrical connector. The electrical connector includes an upper cap configured to engage with an end cap, the upper cap including an upper cap insert that is independent from the upper cap in at least one axis of motion, and the end cap, including one or more contact blades configured to receive an insulated cable, in which as the upper cap engages with the end cap the upper cap insert presses the insulated cable onto the one or more contact blades such that the one or more contact blades are in electrical connection with one or more conductors in the insulated cable.

In some implementations, the upper cap is configured to rotationally engage with the end cap and the upper cap is rotationally independent from the upper cap. In some implementations, the upper cap and the end cap each further include screw threads that are configured to engage with each other. In some implementations, the electrical connector further includes at least one alignment element to prevent the upper cap insert from moving in the at least one axis of motion as the upper cap engages with the end cap. In some implementations, the at least one alignment element includes one or more end cap posts on the end cap, and one or more corresponding end cap holes on the upper cap. In some implementations, the at least one alignment element includes one or more interior flat surfaces formed on the end cap, and one or more corresponding interior flat surfaces formed on the upper cap. In some implementations, the electrical connector further includes at least one gasket on the upper cap and/or the end cap, in which as the upper cap engages with the end cap the at least one gasket forms a watertight seal around the one or more contact blades. In some implementations, the one or more contact blades are also in electrical connection with a device such that as the upper cap engages with the end cap there is an electrical connection between the insulated cable and the device. In some implementations, the device includes a luminaire. In some implementations, as the upper cap engages with the end cap the upper cap undergoes both a rotational and a translational motion with respect to the end cap, and the upper cap insert undergoes a translational motion with respect to the end cap.

Further implementations disclosed herein include a method for providing an electrical connection, the method including aligning an upper cap with an end cap, in which the upper cap includes an upper cap insert that is independent from the upper cap in at least one axis of motion, and the end cap includes one or more contact blades configured to receive an insulated cable, and engaging the upper cap with the end cap, in which as the upper cap engages with the end cap the upper cap inserts presses the insulated cable onto the one or more contact blades such that the one or more contact blades are in electrical connection with one or more conductors in the insulated cable.

In some implementations, the upper cap is configured to rotationally engage with the end cap and the upper cap is rotationally independent from the upper cap. In some implementations, the upper cap and the end cap each further include screw threads that are configured to engage with each other. In some implementations, the upper cap and the end cap further include at least one alignment element to prevent the upper cap insert from moving in the at least one axis of motion as the upper cap engages with the end cap. In some implementations, the at least one alignment element includes one or more end cap posts on the end cap, and one or more corresponding end cap holes on the upper cap. In some implementations, the at least one alignment element includes one or more interior flat surfaces formed on the end cap, and one or more corresponding interior flat surfaces formed on the upper cap. In some implementations, there is at least one gasket on the upper cap and/or the end cap, in which as the upper cap engages with the end cap the at least one gasket forms a watertight seal around the one or more contact blades. In some implementations, the one or more contact blades are also in electrical connection with a device such that as the upper cap engages with the end cap there is an electrical connection between the insulated cable and the device. In some implementations, as the upper cap engages with the end cap the upper cap undergoes both a rotational and a translational motion with respect to the end cap, and the upper cap insert undergoes a translational motion with respect to the end cap.

Further implementations disclosed herein include an electrical connector, including means for engaging an upper cap of an electrical connector with an end cap of the electrical connector, means for creating an electrical connection between the end cap and an insulated cable inserted between the upper cap and the end cap as the upper cap and the end cap are engaged, and means for preventing movement of the insulated cable in at least one axis of motion when the upper cap is engaged with the end cap. In some implementations, the electrical connector further includes means for aligning the upper cap with the end cap before the upper cap engages with the end cap.

These and other features of the present embodiments will be understood better by reading the following detailed description, taken together with the figures herein described. The accompanying drawings are not intended to be drawn to scale. For purposes of clarity, not every component may be labeled in every drawing.

DETAILED DESCRIPTION

The apparatuses and methods disclosed provide a waterproof splice connector that is easy to install and may connect multiple cables. The splice connector includes an upper cap that screws into an end cap. The end cap includes electrical contact blades for piercing the insulation of a cable that is inserted into the splice connector. The upper cap includes an upper cap insert that is independent from the upper cap in at least one axis of motion. For example, the upper cap insert may be rotationally independent from the upper cap along a central rotational axis of the upper cap. In other words, when the upper cap is rotationally engaged with the end cap, the upper cap undergoes both rotational and translational motion while the upper cap undergoes translational motion but not rotational motion. For example, the end cap and upper cap may include one or more elements used to hold the upper cap stationary in relation to the end cap while the upper cap is screwed on. The upper cap insert may press the cable down onto the contacts in the end cap when the upper cap is screwed onto the end cap. However, since the upper cap insert remains rotationally stationary, the cable also remains straight and is not twisted by the screwing action of the upper cap. Each of the upper cap and the end cap may include a gasket that mates together to form a watertight seal around the electrical connection.

Figure 1:
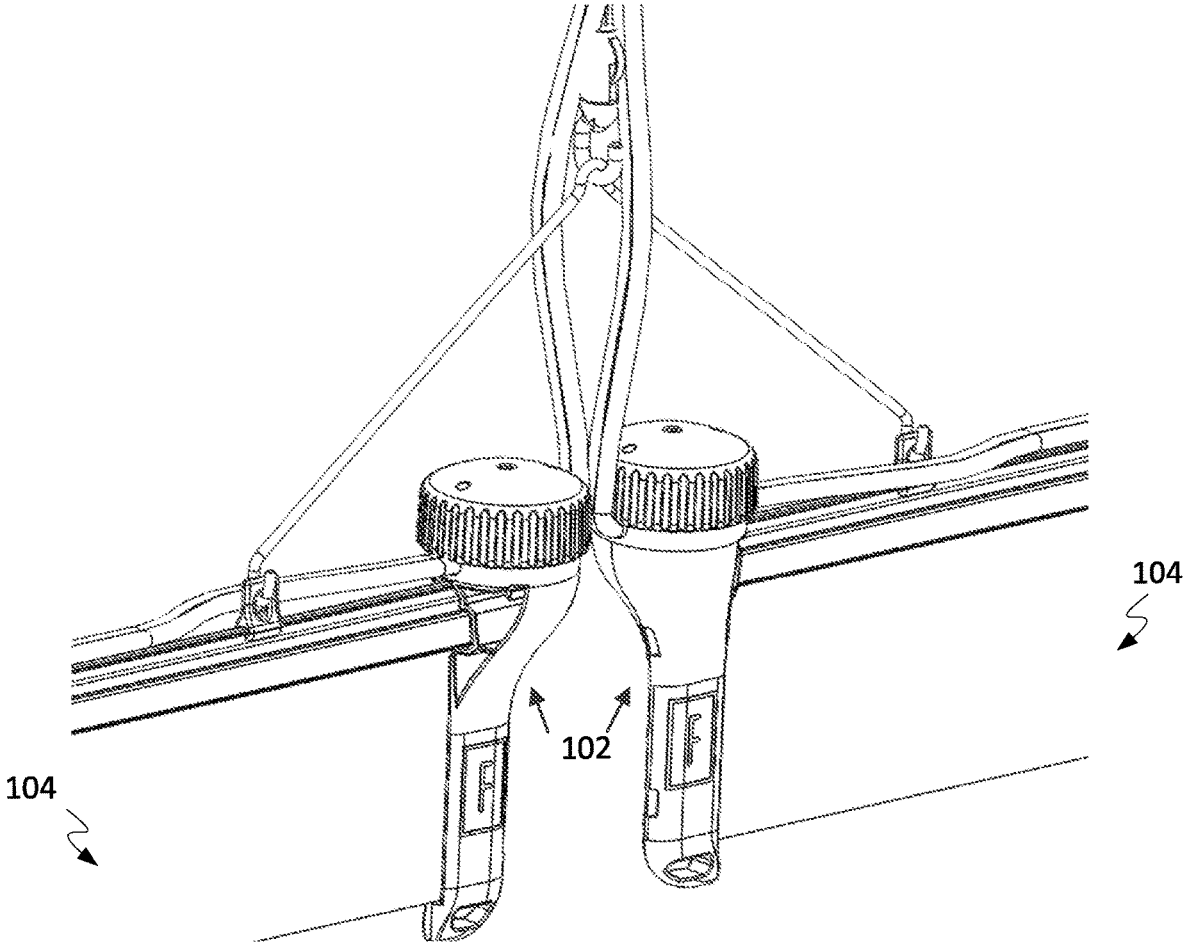
FIG. 1 is a diagram illustrating an application of a splice connector in accordance with various embodiments.

FIG. 1 is a diagram illustrating an application of a splice connector in accordance with various embodiments. In FIG. 1, splice connectors 102 are each attached to an end of luminaires 104. The luminaires 104 may be in a wet or humid environment, such as an indoor farming, vertical farming, or greenhouse environment. Such environments are wet and/or humid in order for plant growth, so it is important that the electrical connections for the luminaire 104 are waterproof. The splice connectors 102 may be used to connect the luminaires 104 with a power source. Power connections usually include both a positive voltage and ground or negative connection, which means the splice connectors 102 make two separate electrical connections between the power source and the luminaires 104.

FIG. 1 illustrates one particular use case of the splice connectors 102, but in general the splice connectors 102 may be utilized in a number of different environments (which may or may not be wet or humid), and may be used to connect a number of different devices (not limited to luminaires). Different applications or use cases of the splice connectors 102 may be appreciated by a person of ordinary skill in the art.

Figure 2:
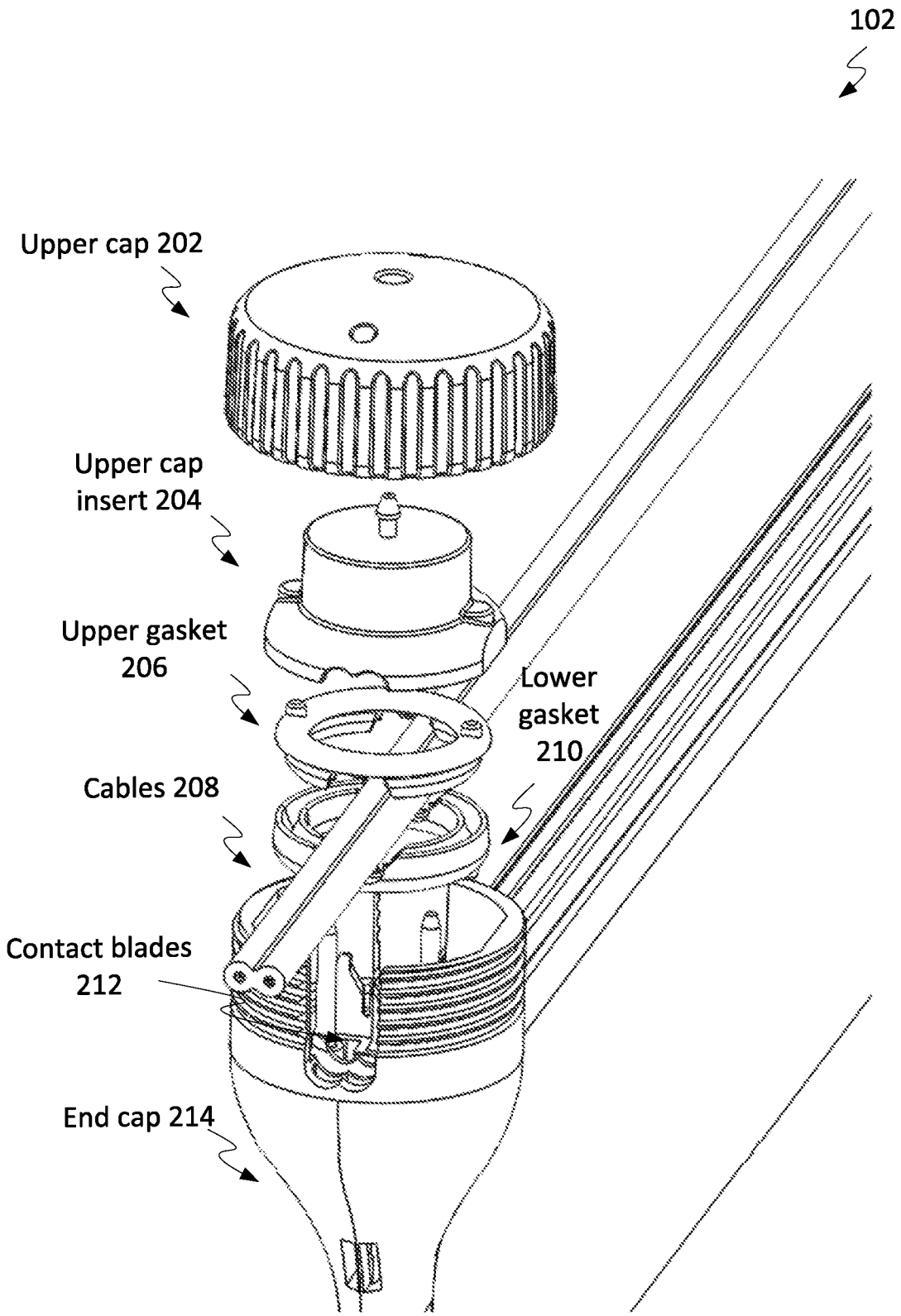
FIG. 2 is an exploded view of a splice connector in accordance with various embodiments.
Figure 3:
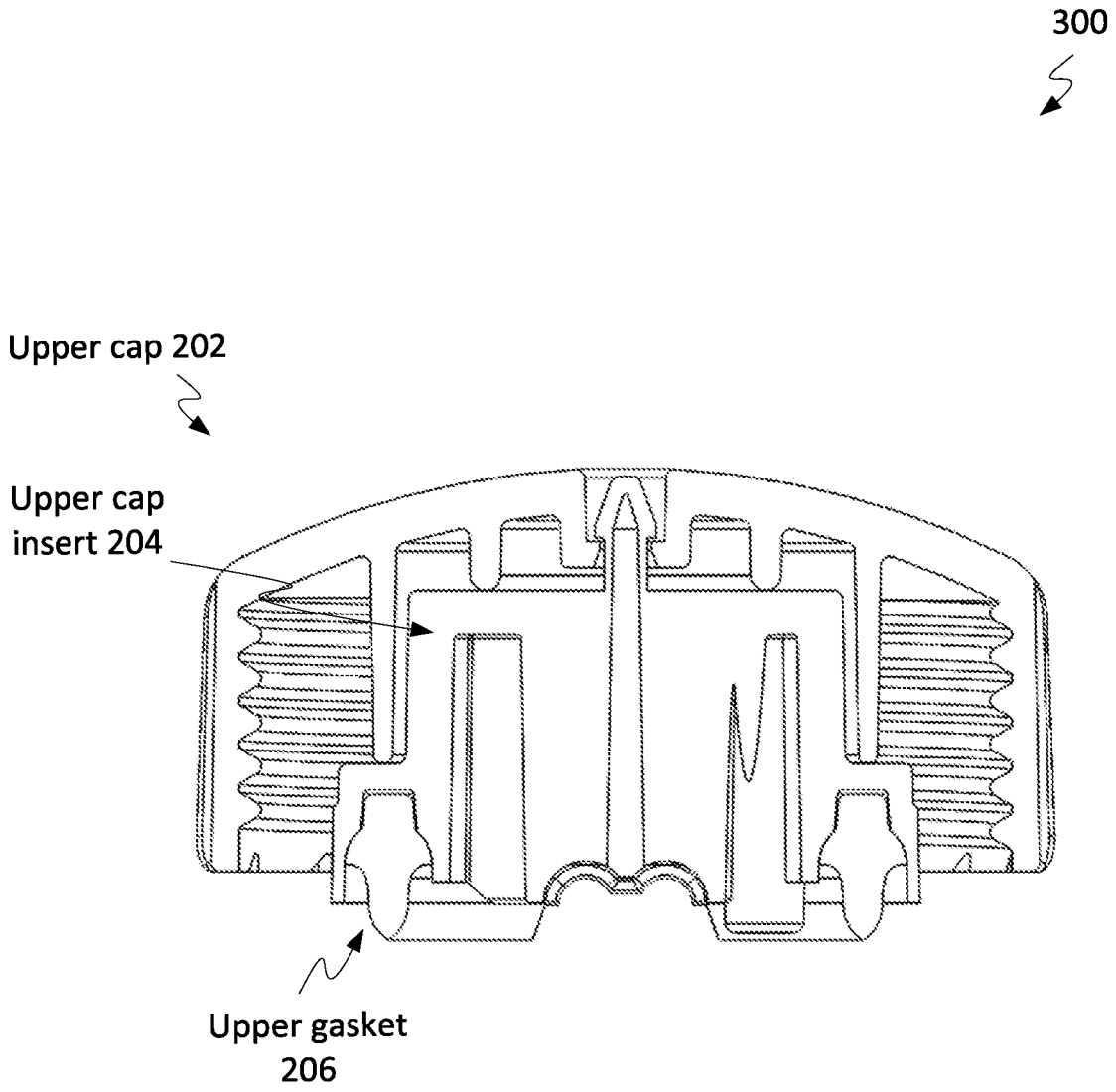
FIG. 3 is a cutaway view of the upper cap of a splice connector in accordance with various embodiments.

FIG. 2 is an exploded view of the splice connector 102 in accordance with various embodiments. The splice connector 102 may include upper cap 202. FIG. 3 is a cutaway view 300 of the upper cap 202 in accordance with various embodiments. The interior of the upper cap 202 may include threads used to screw the upper cap onto end cap 214. An upper cap insert 204 is attached to the interior of the upper cap 202. The upper cap insert 204 is independent from the upper cap 202 in at least one axis of motion. For example, the upper cap insert 204 may rotate independently from the upper cap 202 along a common axis of both the upper cap insert 204 and the screw insert 202 (e.g., a central vertical axis), or may remain stationary while the upper cap 202 rotates. In other words, the upper cap insert 204 may be rotationally independent from the upper cap 202. The upper cap 202 may also include an upper gasket 206 that forms half of a watertight seal for the splice connector 102.

Figure 6:
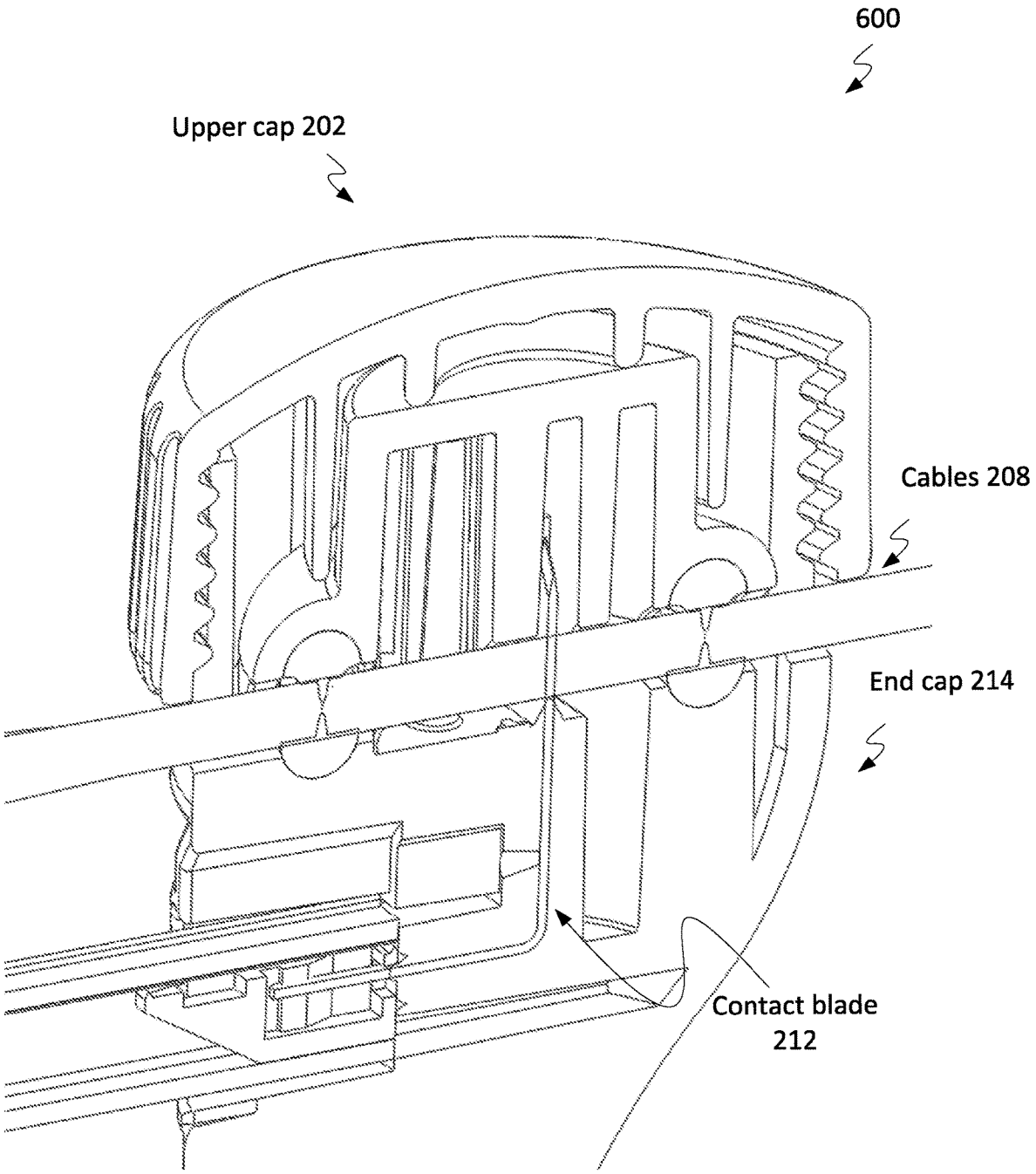
FIG. 6 is a diagram illustrating an electrical connection in a closed splice connector in accordance with various embodiments.

The end cap 214 may include threads that mate with the threads in the upper cap 202. The end cap 214 may also include contact blades 212. The contact blades 212 are shaped to form a trough or cradle upon which cables 208 may rest (e.g., a V shape). The top of the contact blades 212 are sharpened or beveled to pierce the insulator of the cables 208 and conduct electricity flowing from the cables 208. In other words, the contact blades enable a splice, or insulation displacement, connector. There may be a separate contact blade 212 for each insulated conductor that will be placed in the splice connector 202. The placement of the contact blades 212 may be staggered (e.g., not right next to each other) to prevent arcing between the separate conductors. The contact blades 212 may be conduct electricity from the cables 208 to a device connected to the end cap 214 (e.g., luminaire 104), as shown by diagram 600 in FIG. 6. For example, the contact blades 212 may extend downward through the end cap 214 to another electrical interface between the end cap 214 and the device connected to the end cap 214. The end cap 214 may also include a lower gasket 210 that when combined with the upper gasket 206 of the upper cap 202 forms a watertight seal around the electrical connection.

In some implementations, the splice connector 102 may support power line communications (PLC) between the cables 208 and the device connected to the end cap 214. In alternate implementations, the contact blades 208 may be replaced by components to enable another type of electrical connection. For example, the splice connector 102 may be configured to enable a wire-nut connector that connects two wires together.

The upper cap insert 204, upper gasket 210, lower gasket 210, and end cap 214 may each have grooves on opposite sides to accommodate the cables 208 within the splice connector 102. The grooves may be lined up to provide a straight, snug enclosure for the cables 208 once the upper cap 202 and the end cap 214 are screwed together. To make the electrical connection, a person may slide the cables 208 into the end cap 214, resting on the contact blades 212. The person may then screw the upper cap 202 onto the end cap 214. While the upper cap 202 moves rotationally and translationally downward during the screw-in process, the upper cap insert 204 remains rotationally stationary and but moves translationally downward on the cables 208 so that the contact blades 212 cut through the insulators of the cables 208 to make the electrical connection. Once the upper cap 202 is tightly screwed to the end cap 214, the cables 208 should remain secure within the splice connector 102. In addition, the upper gasket 206 and lower gasket 210 form an aperture smaller than the profile of the cables 208 to form a watertight seal around the contact blades 212. The upper gasket and lower gasket 208 may also include additional ribs to ensure sealing of any spaces between the gaskets and the cables 208. While FIG. 2 illustrates the cables 208 having two insulated conductors, in general the splice connector 102 may have configured to house any number of conductors and any number of cables.

Figure 4:
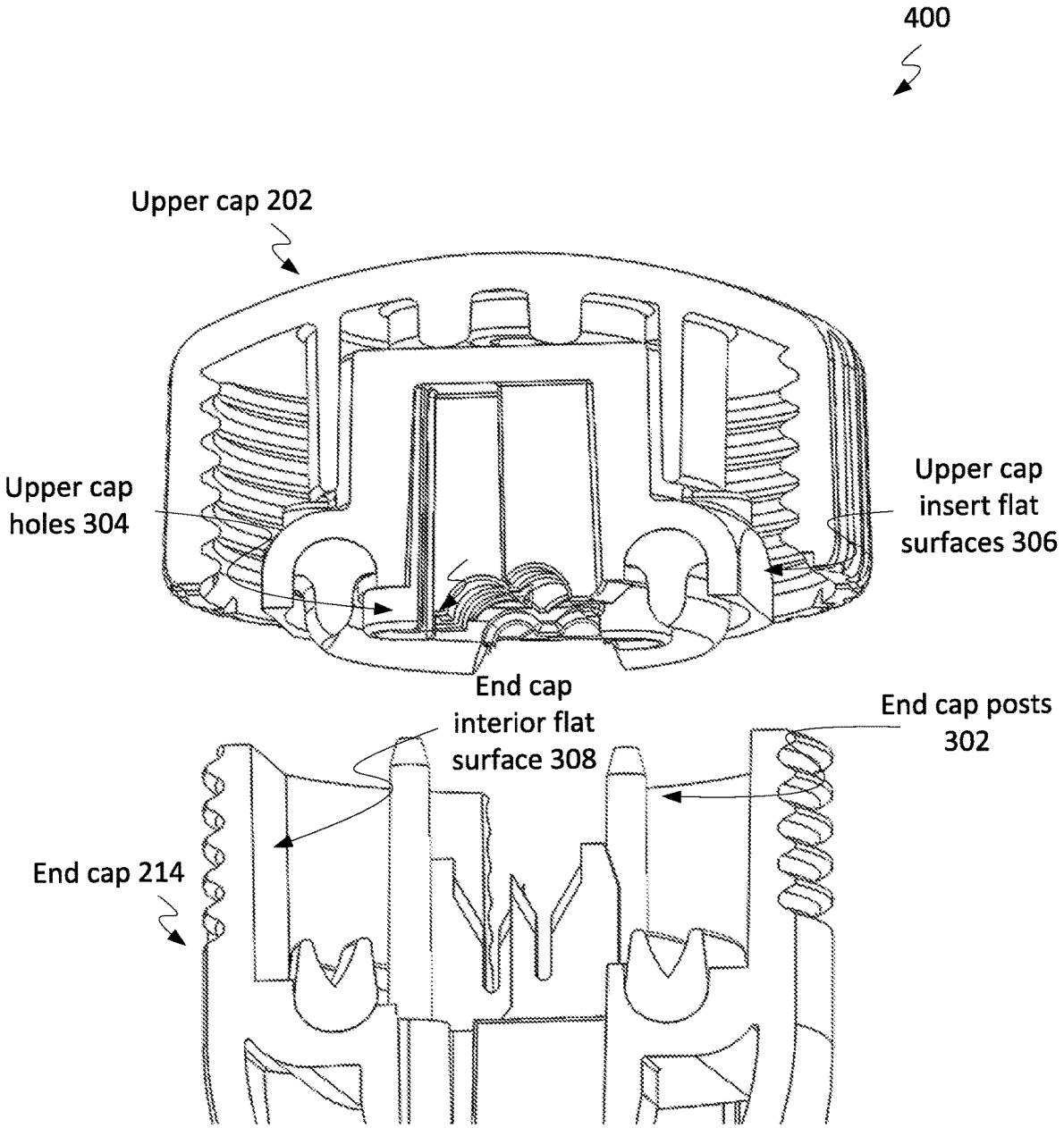
FIG. 4 is a cutaway view of a splice connector in accordance with various embodiments.

The upper cap 202 and the end cap 214 may have one or more alignment elements to prevent the upper cap insert 204 from rotating while the upper cap 202 is being screwed onto the end cap 214, as shown by cutaway view 400 in FIG. 4. For example, the end cap 214 may have one or more end cap posts 302 and the upper cap insert 204 may have one or more corresponding upper cap holes 304. When the upper cap 202 is placed on top of the end cap 214, the upper cap holes 304 may be lined up with the end cap posts 302 so that the end cap costs 302 insert into the upper cap holes 304. This prevents the upper cap insert 204 from rotating while the upper cap 202 is being screwed onto the end cap 214.

In addition or alternatively, the upper cap insert 204 may have one or more upper cap insert interior flat surfaces 306, and the end cap 214 may have corresponding interior flat surfaces 308 as well. When the upper cap 202 is aligned with the end cap 214, the flat surfaces should be lined up. This also prevents the upper cap insert 204 from rotating while the upper cap 202 is being screwed onto the end cap 214. The alignment elements may also prevent the screw threads of the upper cap 202 from engaging with the screw threads of the end cap 214 when the upper cap 202 and the end cap 214 are not properly aligned.

Figure 5:
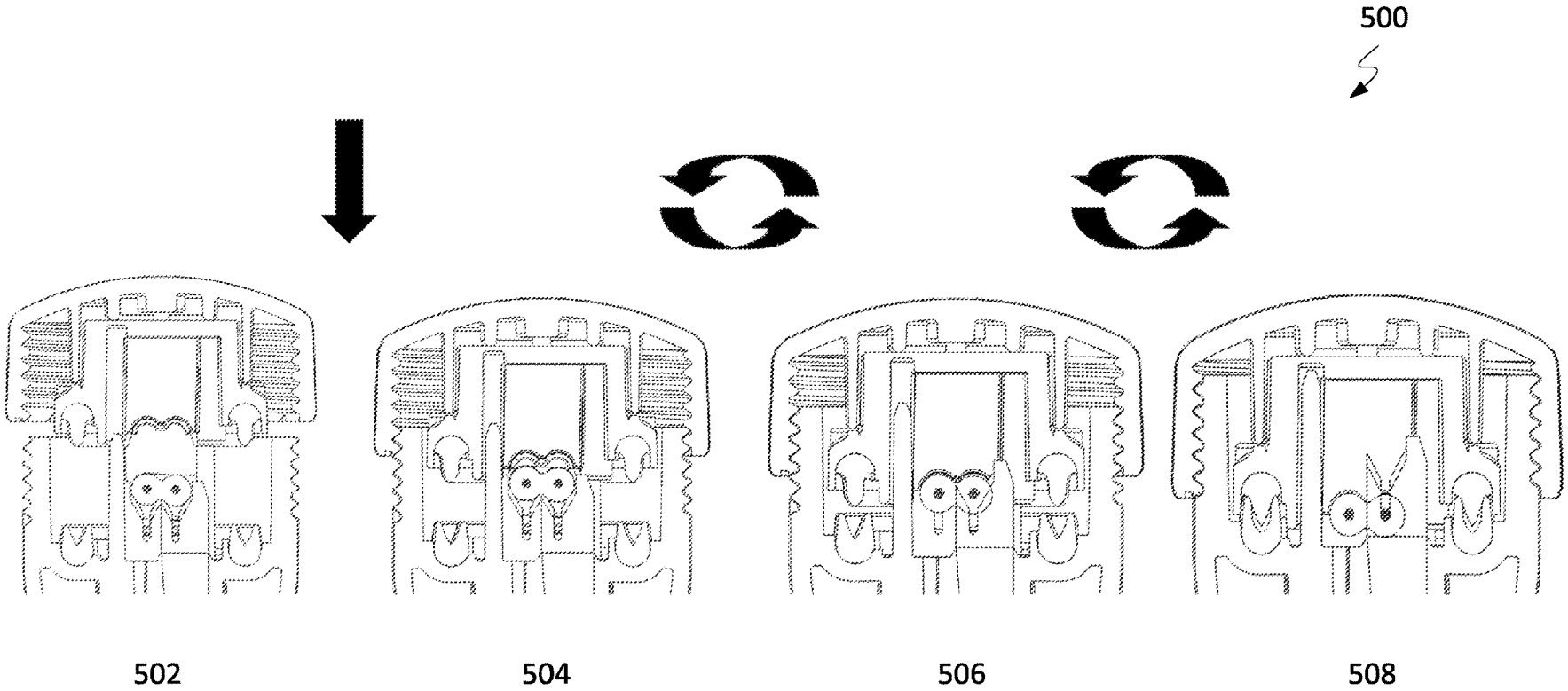
FIG. 5 is a diagram illustrating a method of operating a splice connector in accordance with various embodiments.

FIG. 5 is a diagram illustrating a method 500 of operating a splice connector 102 in accordance with various embodiments. Method 500 may be performed by a person installing the electrical connection between a device (e.g., luminaire 104) and another electrical source (e.g., a power source). The waterproof nature of the splice connector and the ease of making the electrical connection make the splice connector suitable for installation in wet or humid environments, such as an indoor farming or greenhouse environment.

In step 502, the cables are inserted through the end cap, resting on the contact blades. The upper cap of the splice connector is then aligned with the end cap. The alignment elements of the splice connector, such as described with respect to FIG. 4, may be aligned such that as the upper cap engages onto the end cap, the upper cap insert may remain stationary. In step 504, the upper cap should be pressed down until the threads of the upper cap and the end cap engage with each other.

In step 506, the upper cap is rotationally screwed onto the end cap. As the upper cap rotates, the screw threads on the upper cap and the end cap engage, so that the upper cap undergoes both a rotational and translational (e.g., downward) motion along the rotational axis with respect to the end cap. The upper cap insert is held rotationally stationary by the alignment elements such that the upper cap insert only undergoes a translational (e.g., downward) motion but not a rotational motion with respect to the end cap. As the upper cap is screwed in, the upper cap insert presses the cables downward onto the contact blades, allowing the blades to cut into the cable insulator.

In step 508, when the threads of the upper cap and the end cap are fully engaged, the contact blades have penetrated the cable insulator and are in electrical contact with the conductors in the cables. The cables are secured to the splice connector and should not move significantly. The upper and lower gaskets in the upper cap and the end cap respectively form a watertight seal around the contact blades.

Other Considerations

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

What is claimed is:

1. An electrical connector, comprising:

an upper cap configured to engage with an end cap, the upper cap comprising an upper cap insert that is independent from the upper cap in at least one axis of motion;

the end cap, comprising one or more contact blades configured to receive an insulated cable; and at least one alignment element to prevent the upper cap insert from moving in the at least one axis of motion as the upper cap engages with the end cap, wherein the at least one alignment element comprises one or more cylindrical pins on the end cap and one or more corresponding cylindrical holes on the upper cap;

wherein as the upper cap engages with the end cap the upper cap insert presses the insulated cable onto the one or more contact blades such that the one or more contact blades are in electrical connection with one or more conductors in the insulated cable.

2. The electrical connector of claim 1, wherein the upper cap is configured to rotationally engage with the end cap and the upper cap is rotationally independent from the upper cap.

3. The electrical connector of claim 2, wherein the upper cap and the end cap each further comprise screw threads that are configured to engage with each other.

4. The electrical connector of claim 1, wherein the at least one alignment element further comprises:

one or more interior flat surfaces formed on the end cap; and one or more corresponding interior flat surfaces formed on the upper cap.

5. The electrical connector of claim 1, further comprising:

at least one gasket on the upper cap and/or the end cap, wherein as the upper cap engages with the end cap the at least one gasket forms a watertight seal around the one or more contact blades.

6. The electrical connector of claim 1, wherein the one or more contact blades are also in electrical connection with a device such that as the upper cap engages with the end cap there is an electrical connection between the insulated cable and the device.

7. The electrical connector of claim 6, wherein the device comprises a luminaire.

8. The electrical connector of claim 1, wherein as the upper cap engages with the end cap:

the upper cap undergoes both a rotational and a translational motion with respect to the end cap; and the upper cap insert undergoes a translational motion with respect to the end cap.

9. A method for providing an electrical connection, comprising:

aligning an upper cap with an end cap, wherein:

the upper cap comprises an upper cap insert that is independent from the upper cap in at least one axis of motion;

the end cap comprises one or more contact blades configured to receive an insulated cable; and the upper cap and the end cap further comprise at least one alignment element to prevent the upper cap insert from moving in the at least one axis of motion as the upper cap engages with the end cap, wherein the at least one alignment element comprises one or more cylindrical pins on the end cap and one or more corresponding cylindrical holes on the upper cap;

engaging the upper cap with the end cap, wherein as the upper cap engages with the end cap the upper cap inserts presses the insulated cable onto the one or more contact blades such that the one or more contact blades are in electrical connection with one or more conductors in the insulated cable.

10. The method of claim 9, wherein the upper cap is configured to rotationally engage with the end cap and the upper cap is rotationally independent from the upper cap.

11. The method of claim 10, wherein the upper cap and the end cap each further comprise screw threads that are configured to engage with each other.

12. The method of claim 9, wherein the at least one alignment element further comprises:

one or more interior flat surfaces formed on the end cap; and one or more corresponding interior flat surfaces formed on the upper cap.

13. The method of claim 9, wherein:

there is at least one gasket on the upper cap and/or the end cap, wherein as the upper cap engages with the end cap the at least one gasket forms a watertight seal around the one or more contact blades.

14. The method of claim 9, wherein the one or more contact blades are also in electrical connection with a device such that as the upper cap engages with the end cap there is an electrical connection between the insulated cable and the device.

15. The method of claim 9, wherein as the upper cap engages with the end cap:

the upper cap undergoes both a rotational and a translational motion with respect to the end cap; and the upper cap insert undergoes a translational motion with respect to the end cap.

* * * * *